United States Patent [19]

Aumercier

[11] Patent Number: 5,072,489

[45] Date of Patent: Dec. 17, 1991

[54] HINGE FOR DOOR OR WINDOW, THE LEAF FRAME OF WHICH IS PARTIALLY OVERLAPPING THE SASH-FRAME

[75] Inventor: Laurent Aumercier, Phalsbourg, France

[73] Assignee: Ferco International Usine De Ferrures De Batiment, Sarrebourg, France

[21] Appl. No.: 525,700

[22] Filed: May 21, 1990

[30] Foreign Application Priority Data

Jun. 2, 1989 [FR] France ..... 89 07501

[51] Int. Cl.[5] ..... E05D 15/06

[52] U.S. Cl. ..... 16/361; 16/364; 49/257

[58] Field of Search ..... 16/361, 363, 364; 49/213, 257, 258, 260

[56] References Cited

U.S. PATENT DOCUMENTS 3,453,777 7/1969 Reilly .
3,797,169 3/1974 Armstrong ..... 16/361

FOREIGN PATENT DOCUMENTS 2324490 12/1974 Fed. Rep. of Germany .
726512 3/1955 United Kingdom ..... 49/257
1308927 3/1973 United Kingdom .
2010368 6/1979 United Kingdom .

*Primary Examiner*—Robert L. Spruill
*Assistant Examiner*—Carmine Cuda
*Attorney, Agent, or Firm*—Sandler, Greenblum, & Bernstein

[57] ABSTRACT

Hinge for a door, window or the like, the sash of which is partially overlapping the sash-frame and outwardly tiltable about a horizontal spindle located at the height of its upper rail including a) hinged lower compass arms imparting to the sash, at the very beginning of its opening, a path with vertical components, b) and upper hinge elements capable of simultaneously outwardly projecting the upper rail of the sash during the substantially vertical movement thereof. The hinge includes an assistance mechanism to push back, vertically and upwards, the sash at the end of closing, and to simultaneously position and center the sash with respect to the sash-frame.

13 Claims, 1 Drawing Sheet

HINGE FOR DOOR OR WINDOW, THE LEAF FRAME OF WHICH IS PARTIALLY OVERLAPPING THE SASH-FRAME

The invention relates to a hinge for a door, window or the like, the sash of which is partially overlapping the sash-frame and outwardly tiltable about a horizontal spindle located at the height of its upper rail. This hinge comprises:

a) hinged lower compass arms imparting to the sash, at the very beginning of the opening, a path with vertical components, b) and upper hinge elements capable of simultaneously outwardly projecting the upper rail of the sash during the substantially vertical moving of same.

BACKGROUND OF THE INVENTION

There are already known a number of hinges for a door, window or the like which are outwardly tiltable about a horizontal axis, and generally called opening in the Italian way. However, a new generation of hinges has very recently been developped, the peculiarity of which resides in their arrangement in fillisters of the sash and sash-frame.

This arrangement has given rise to a number of problems mainly due to the specific structure of the sash; namely the presence of a peripheral covering lip, which, in closed position of the door, window or the like, presses against the outer face of the sash. This structure has required the design of hinges capable of outward offset, at the very beginning of the opening, the upper rail of the sash with respect to said sash-frame. Because of this location in fillisters of the hinges, the fictive rotation axis of the sash is, indeed, necessarily arranged on the front side of the upper edge of same. Moreover, the elimination of this peripheral covering lip did not seem to be envisageable and this for reasons of tightness and insulation of the door, window or the like.

Thus, there are already known hinges for leaves tilting in the Italian way, comprised of upper hinge elements connecting the sash, at the level of its side stiles and near to its upper rail, to the sash-frame. In fact, these upper hinge elements are comprised of a keeper with gradients arranged in fillisters and on the side stiles of the sash-frame. In these keepers with gradients moves a roller integral with an intermediate element inserted onto the side stiles of the sash.

The main function of the upper hinge elements is to allow not only the tilting in the Italian way of the sash, but, in addition, the outward projection of the upper rail of the sash with respect to the sash-frame at the very beginning of the opening. These same hinge elements also permit the return of the upper rail of the sash against the sash-frame when closing the door, window or the like.

In order to avoid premature wear of the sealing on the inner face of the covering lip provided at the peripheral border of the sash, it is preferable for the separation of the upper rail of the sash to effectively occur at the very beginning of the opening and not beyond an initial angle of rotation of the sash. For this purpose, it is known to connect the side stiles of the sash with those of the sash-frame by means of lower compass arms which are preferably hinged, to thereby allow a lowering by gravity of the sash at the very beginning of its opening and following actuation of the locking mechanism. In fact, this moving with preliminary vertical components allows to impart to the upper rail of the sash an immediate moving with horizontal components and not beyond a first rotation of a non-negligible amplitude, such as occurred in the past.

On the other hand, when closing again the door, window or the like, thrusts arranged in fillisters on the side stiles of the sash cause the re-erecting of the lower compass arms and, simultaneously, a vertical and upward moving of the sash along with a horizontal moving of the upper rail of the sash in the direction of the sash, in order to complete the tightness of the door, window or the like.

Although providing a solution for the problem which arises with respect to a sash partially overlapping the sash-frame and opening in the Italian way, it is also convenient to solve the problems due to the backlash in the various joints as well as the effect induced. Both the components of the upper hinge elements and the lower compass arms necessarily have some backlash at the level of their various connections, irrespective of the precautions taken at the time of their machining. Furthermore, these backlashes naturally tend to increase in the course of time. Now, the sum of these various backlashes existing at the level of the mechanical connections have, of course, consequential effects on the working of the door, window or the like. In particular, they are generally the cause of a loss of centering of the sash with respect to the sash-frame, which results in poor tightness and difficult locking of the door, window or the like.

Moreover, these backlashes make the closing operation of the sash more delicate, since the sash is no longer naturally lifted up with respect to the sash-frame under the impulse of the lower compass arms when same are re-erected. In fact, this operation requires the intervention of the user. The user being obliged to exert, when closing the door, window or the like, an action with ascending components onto the actuating handle acting onto the locking mechanism and generally located on the lower rail of the sash, so as to cause the lifting up of the sash with respect to the sash-frame. All things considered, only further to this action, which is not natural for the user, the rollers of the hinge elements will climb up in the keepers with gradients arranged on the side stiles of the sash-frame.

It should be noted, in addition, that this combined action of traction and lifting exerted, at the time of closing, onto the actuating handle acting onto the locking mechanism has also a tendency to exert a high strain thereon, which can result into a premature wear.

The object of this invention is to cope with all the above-mentioned troubles by providing a hinge for a door, window or the like tilting in the Italian way capable, at the time of closing of imparting an ascending motion to the sash without the assistance of the user, and perfectly centering, during this operation, the sash with respect to the sash-frame.

SUMMARY OF THE INVENTION

The invention relates to a hinge for a door, window or the like, the sash of which is partially overlapping the sash-frame and opening in the Italian way, comprising:

a) hinged lower compass arms imparting to the sash, at the very beginning of the opening, a path with vertical components, b) and upper hinge elements capable of simultaneously outwardly projecting the upper rail of the sash during the substantially vertical moving of same, and the hinge includes means of assistance to push back, vertically and upwardly, the sash at the end of closing, and to simultaneously position and center the sash with respect to the sash-frame.

The advantages obtained thanks to this invention reside in that backlash resulting from complex hinges can perfectly be controlled and have no effect on the working of the door, window or the like, or on other hinge elements fitted therewith, such as the locking mechanism.

Other objects and advantages of this invention will become appearant during the description which follows. The understanding of this description will be made easier referring to the accompanying drawing.

BRIEF DESCRIPTION OF THE DRAWINGS

FIG. 4 is a schematic and perspective view of the means of assistance contributing to a better working of the door, window or the like.

DESCRIPTION OF THE PREFERRED EMBODIMENTS

Figure 2:
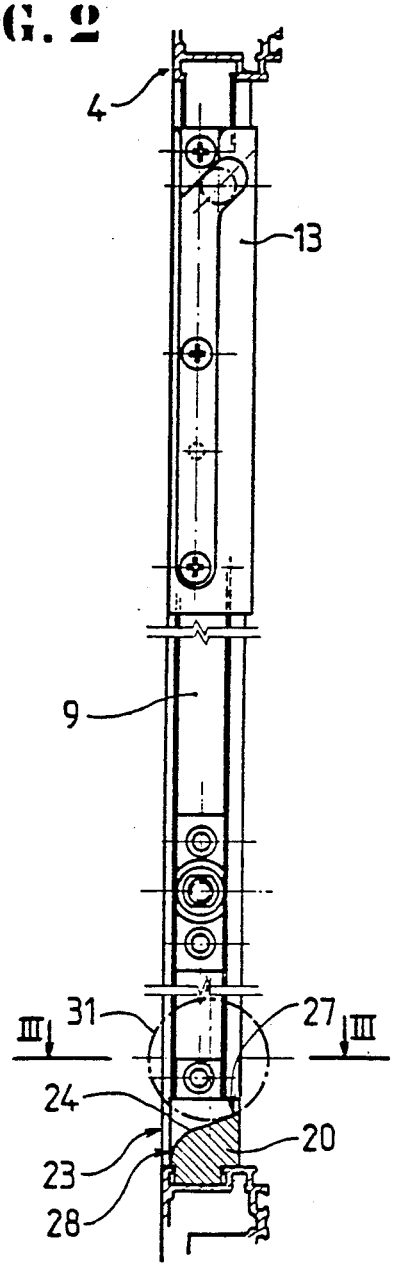
Figure 1:
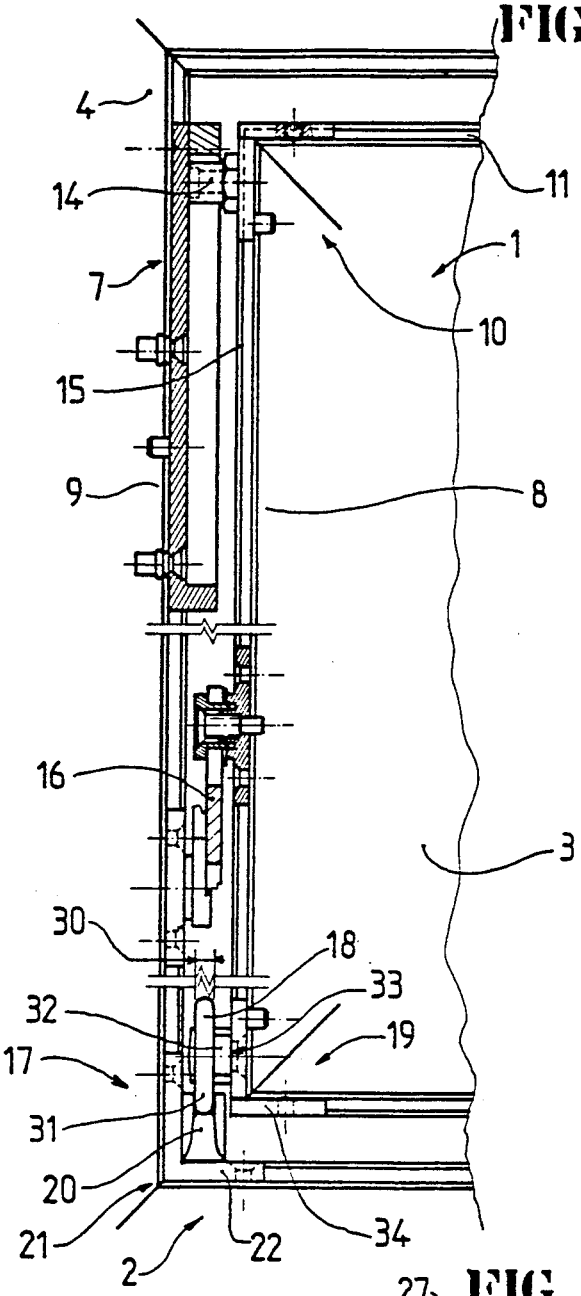
FIG. 1 is a schematic, elevation and partly cross-sectional view of a hinge, according to the invention, arranged in fillisters of the side stiles of a sash and a sash-frame of a door, window or the like, FIG. 2 is a schematic and elevational view of one of the side stiles of the sash-frame fitted with a hinge, such as shown in FIG. 1.
Figure 3:
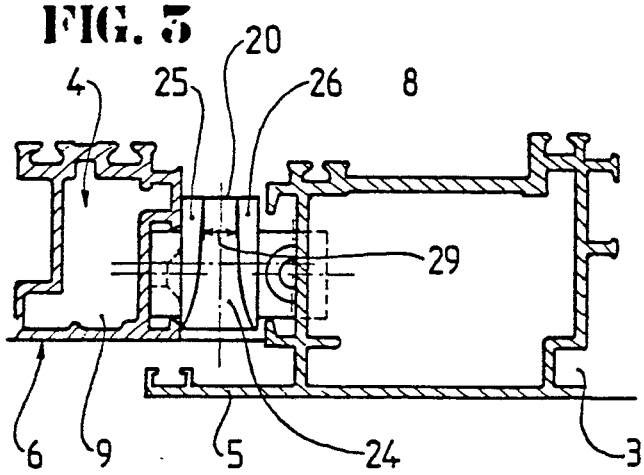
FIG. 3 is a cross-sectional view according to III—III of FIG. 2.
Figure 4:
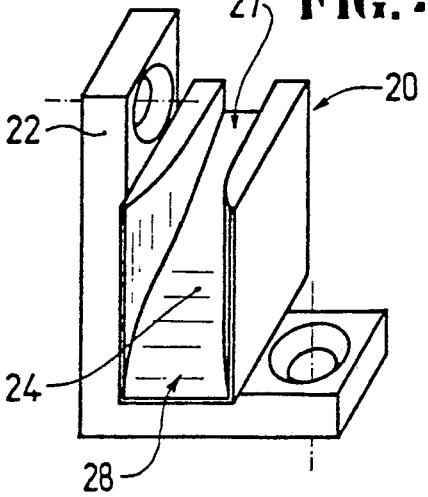

This invention relates to a hinge 1 for a door, window or the like 2, the sash 3 of which is of the tilting type which opens in the Italian way. The sash 3 partially overlaps the sash-frame 4 and comprises, at the peripheral rim, a covering lip 5 which, in closed position of the door, window or the like, applies against the outer face 6 of the sash-frame 4.

More particularly, the hinge 1 comprises upper hinge elements 7 arranged in fillisters on the side stiles 8, 9, respectively, of the sash 3 and the sash-frame 4 and near the upper corners 10 thereof.

The main function of these upper hinge elements 7 is, on the one hand, to ensure the rotation, about a horizontal spindle, of the sash 3 and, on the other hand, to impart to the upper rail 11 of the sash 3 a path with horizontal components at the very beginning of opening of the door, window or the like. This outward projection, of the sash 3 with respect to the sash-frame 4 is necessary because of the arrangement, in fillisters, of these upper hinge elements 7. Since the hinge element are arranged, in these circumstances, on the front side of the upper edge of the sash 3 and, viz., of the covering lip 5, this would impede the rotation, about a horizontal axis, of the sash 3.

In fact, these upper hinge elements 7 are mainly comprised of a keeper 13 provided with gradients arranged on the side stiles 9 of the sash-frame 4. In these keepers 13 with gradients moves a roller 14 integral with a supporting element 15 inserted onto the side stiles 8 of the sash 3. Of course, this invention is not limited at all to such an embodiment of the upper hinge elements 7.

The hinge 1, according to the invention, includes hinged-type lower compass arms 16, also arranged in fillisters, connecting the side stiles 8 of the sash 3 to the side stiles 9 of the sash-frame 4. The function of these lower compass arms 16 is, when opening the door, window or the like, to outwardly project the lower part of the sash 3. They also impart to the sash a path with vertical components at the very beginning of the opening, so that, by means of the upper hinge elements 7, the upper rail 11 of said sash is immediately separated with respect to the sash-frame 4.

Because of the backlashes existing at the level of each of the joints connecting the various components of both the upper hinge elements 7 and the lower compass arms 16, the sash 3 runs a great risk of losing its centering with respect to the sash-frame 4. Moreover, the climbing up of the rollers 14 in their corresponding keeper 13 with gradients becomes difficult at the end of closing of the door, window or the like.

In order to cope with these troubles, the hinge 1 comprises, in addition and according to a feature of this invention, means of assistance 17 to, on the one hand, perfectly center the sash 3 with respect to the sash-frame 4 at the time of closing and, on the other hand, simultaneously push back, vertically and upwards, the sash 3, so as to force the rollers 14 of the upper hinge elements 7 to climb up in their keeper 13 with gradients.

These means of assistance 17 are preferably comprised of, on the one hand, rolling means 18 fitting the side stiles 8 of the sash 3, near the lower corners 19 thereof. On the other hand, the means of assistance 17 are in the form of wedges 20 arranged in fillisters and in the lower corners 21 of the sash-frame 4. These wedges 20 being made integral therewith by means of appropriate fixing means 22.

More particularly, the wedges 20 comprise, in their front part 23, a curvilinear slope 24 along which the rolling means 18 will move when closing the sash 3. In fact, during their progress along this curvilinear slope 24, the rolling means 18 start a path with vertical components which will cooperate with the sash 3 to lift the sash 3 up with respect to the sash-frame 4, causing the ascending progress of the rollers 14 in their keeper with gradients 13.

All things considered, these means of assistance 17 allow the conversion of a simple traction exerted by the user onto the sash 3 into an effort with vertical components during the locking of the door, window or the like. This results, of course, into an easier working of same.

The wedges 20 comprise, in addition, side rims 25, 26 defining side portions for the aforementioned curvilinear slope 24. More particularly, these side rims 25, 26 are widening from the upper portion 27 to the lower portion 28 of the curvilinear slope 24, so that the access to the curvilinear slope 24 of the rolling means 18 occurs without much difficulty. On the other hand, since these side rims 25, 26 become narrower in the upper portion 27 of the curvilinear slope 24, so as to keep only a distance 29 equal or slightly larger than the thickness 30 of the roller 31 forming said rolling means 18, they are automatically positioned and centered on the wedges 20, which finally results in the centering of the sash 3 with respect to the sash-frame 4.

It should be noted that the rollers 31 of the rolling means 18 are mounted, so as to be freely rotatable on a spindle 32 made integral, at its one end 33, with a connection element 34 connected to the sash 3. This connection element 34 has preferably a right-angle shape and covers the lower corner 19 of the sash 3. Of course, this invention is not limited at all to such an embodiment of this connection element 34 and the rolling means 18 in general.

It should be noted, furthermore, that the fixing means 22 ensuring the connection of the wedges 20 to the sash-frame 20 may also be in the form of a right-angle shaped element engaged into the fillister and in the lower corner 21 of the sash-frame 4.

To conclude, the means of assistance 17, which this invention refers to, contribute in an efficient way to a certain ease of working of the door, window or the like, the sash of which is of the type tilting in the Italian way.

However, it should be observed that this invention can also find application in other types of sashes, the hinges of which are called invisible and sunk into the fillister of the window.

I claim:

1. Hinge for a sash and sash-frame, the sash includes two side stiles, an upper rail and a lower rail, partially overlaps the sash-frame, and is outwardly tiltable to an open position about a horizontal axis located at a height of the upper rail, said hinge comprising:

hinged lower compass arms for imparting a path with vertical components to the sash at beginning of tilting of the sash to the open position;

upper hinge means for simultaneously outwardly projecting the upper rail of the sash during vertical movement of the sash; and assistance means for simultaneously at completion of closing of the sash effecting vertical and centering movement of the sash to position and center the sash with respect to the sash frame.

2. The hinge according to claim 1, wherein said assistance means comprise wedges arranged in lower corners of the sash frame, and means for rolling inserted at lower corners of the sash.

3. The hinge according to claim 2, wherein said wedges include a curvilinear slope capable of imparting to said means for rolling a path having vertical components.

4. The hinge according to claim 3, wherein said curvilinear slope includes a lower, front portion and a higher, rear portion, whereby said curvilinear slope increases in height from said lower, front portion to said higher, rear portion.

5. The hinge according to claim 4, wherein said wedges include side walls positioned on opposite sides of said curvilinear slope.

6. The hinge according to claim 5, wherein said side walls are spaced apart a further distance at said lower, front portion than at said higher, rear portion.

7. The hinge according to claim 6, wherein said means for rolling include a roller having a thickness, and said side walls are spaced apart at said higher, rear portion a difference that is slightly larger than the thickness of said roller.

8. The hinge according to claim 7, wherein said roller is mounted to be freely rotatable on a spindle having an end attached by means for connection to each side stile of the sash.

9. The hinge according to claim 8, wherein said means for connection are right-angle shaped, and cover lower corners of the sash.

10. The hinge according to claim 2, wherein said means for rolling include a roller mounted to be freely rotatable on a spindle having an end attached by means for connection to each side stile of the sash.

11. The hinge according to claim 10, wherein said means for connection are right-angle shaped, and cover lower corners of the sash.

12. The hinge according to claim 2, further including means for fixing said wedges in lower corners of said sash-frame.

13. The hinge according to claim 12, wherein said means for fixing said wedges in lower corners of said sash-frame are right-angle shaped.

* * * * *